US005674542A

United States Patent [19]

Focke et al.

[11] Patent Number: 5,674,542

[45] Date of Patent: Oct. 7, 1997

[54] APPARATUS FOR THE PRODUCTION OF BLANKS FOR COLLARS IN HINGE-LID PACKS WITH ROUNDED OR POLYGONAL LONGITUDINAL EDGES

[75] Inventors: Heinz Focke, Verden; Frank Oberschelp, Langenhagen, both of Germany

[73] Assignee: Focke & Co., (GmbH & Co.), Verden, Germany

[21] Appl. No.: 388,046

[22] Filed: Feb. 10, 1995

[30] Foreign Application Priority Data

Feb. 11, 1994 [DE] Germany ..... 44 04 287.6

[51] Int. Cl.[6] ..... B31B 1/26

[52] U.S. Cl. ..... 425/297; 425/383; 493/405; 493/442

[58] Field of Search ..... 425/271, 272, 425/297, 383; 493/80, 245, 263, 405, 417, 435, 434, 442, 443

[56] References Cited

U.S. PATENT DOCUMENTS

| | | | |
|---|---|---|---|
| 1,367,116 | 2/1921 | Boles | 425/383 |
| 3,130,648 | 4/1964 | Arneson | 93/36 |
| 4,194,440 | 3/1980 | Gorig | 93/39 |
| 4,708,704 | 11/1987 | Focke et al. | 493/151 |
| 4,753,383 | 6/1988 | Focke et al. | 229/160.1 |
| 4,753,384 | 6/1988 | Focke et al. | 229/160.1 |
| 4,918,908 | 4/1990 | Focke et al. | 53/579 |
| 5,066,270 | 11/1991 | Tomanovits | 493/435 |
| 5,261,209 | 11/1993 | Focke et al. | 53/410 |

FOREIGN PATENT DOCUMENTS

| | | |
|---|---|---|
| 476870 | 3/1992 | European Pat. Off. . |
| 508541 | 9/1929 | Germany . |
| 1049780 | 1/1959 | Germany . |
| 1180615 | 10/1964 | Germany . |
| 3515775 | 11/1986 | Germany . |
| 4102005 | 7/1992 | Germany . |

*Primary Examiner*—Thomas R. Weber
*Attorney, Agent, or Firm*—Sughrue, Mion, Zinn, Macpeak, and Seas

[57] ABSTRACT

In the production of hinge-lid packs with rounded or polygonal longitudinal edges, the collar, which is conventional in hinge-lid packs, has to be adapted in the region of the edges (14, 15) formed between collar front wall (11) and collar side tabs (12, 13). For this purpose, a pre-processing of the blanks (10) for the collar in the region of the edges (14, 15) is required. In order to attain a high performance in the production or processing of the blanks, the blanks (10) severed from the web of material (17) are transported, and held during the transport, by an endless blank conveyor (38) including a belt conveyor (23) and an upper conveyor (24).

6 Claims, 3 Drawing Sheets

APPARATUS FOR THE PRODUCTION OF BLANKS FOR COLLARS IN HINGE-LID PACKS WITH ROUNDED OR POLYGONAL LONGITUDINAL EDGES

BACKGROUND OF THE INVENTION

The invention relates to an apparatus for the production of blanks for collars in hinge-lid packs with rounded or polygonal longitudinal edges, wherein the blanks can be severed in succession from a web of material, and fed to a shaping station, in which the collar can be deformed during a stillstand phase by means of shaping tools, thereby forming rounded or polygonal edges between a collar front wall and collar side tabs.

A collar is a component of a hinge-lid pack, which is a widespread pack type for cigarettes. Such a hinge-lid pack is conventionally comprised of a box part and a lid. The latter is hingedly connected to the box part in the region of a rear wall. In the box part, a collar is arranged consisting of a collar front wall and an angular collar side tab, which partly projects from the pack part, and is surrounded by the lid in the closing position.

Recently, hinge-lid packs with rounded or beveled or polygonal edges have appeared in the market. In the hinge-lid packs designed in this manner, the collar must also be adapted to the geometric shape. Edges formed between the collar front wall and the collar side walls thus must have a rounded or polygonal design.

In order to prepare the collar for the aforementioned pack types, a deformation in the region of the edges, namely round shaping or polygonal shaping is required.

In a known apparatus for the production and shaping or pre-shaping the blanks for collars, the collars are transported in the region of a shaping station by levers which are movable to and fro. These levers grasp a blank on its respective rear side, and transport the blank corresponding to an amplitude of motion of the pivotably mounted lever. At the end of the section of motion the blank is free (See DE 41 02 005 corresponding to U.S. Pat. No. 5,261,209).

SUMMARY OF THE INVENTION

The invention relates to a development or alternative of this known apparatus.

The invention is based on the object to propose measures, by which the production, or the preparatory treatment of the collars by shaping the edges can be accelerated, without any loss in quality.

For attaining this object, the apparatus according to the invention is characterized in that the blanks, in the region of the shaping station, are transported by a blank conveyor, which leads through the shaping station, especially by an endless conveyor on whose conveying strand the blanks rest, and which temporarily positions the blanks in the region of the shaping tools.

As an endless conveyor for the collar blanks, according to the invention, a belt conveyor may be considered, on whose conveyor strand the blanks rest such that the collar side tabs project laterally. The belt conveyor is driven in cycles such that, in the region of the shaping tools, especially on a shaping plate, a relatively longer standstill phase takes place. During this standstill phase, the edges are shaped by corresponding pivoting or folding of the collar side tabs by means of appropriate shaping tools, especially shaping rollers. Thereafter, the blank is transported further by the belt conveyor.

In the apparatus according to the invention, the blanks are conveyed through the entire shaping station by one and the same blank conveyor. Holding members, which take effect from above, fix the blanks, above all, in the region of the shaping plate. These holding members are preferably an upper belt, which runs around with the belt conveyor, the lower strand of the upper belt adjoining the top side of the blanks as a pressure strand. Additionally, according to the invention, at least in the region of the shaping plate, pressure members, especially flexible pressing members, are provided, which act against the pressure strand. Thereby, the blank is stably positioned in the region of the shaping tools.

An exemplary embodiment of the apparatus will be described hereinbelow with reference to the drawings, in which:

DESCRIPTION OF A PREFERRED EMBODIMENT

Figure 1:
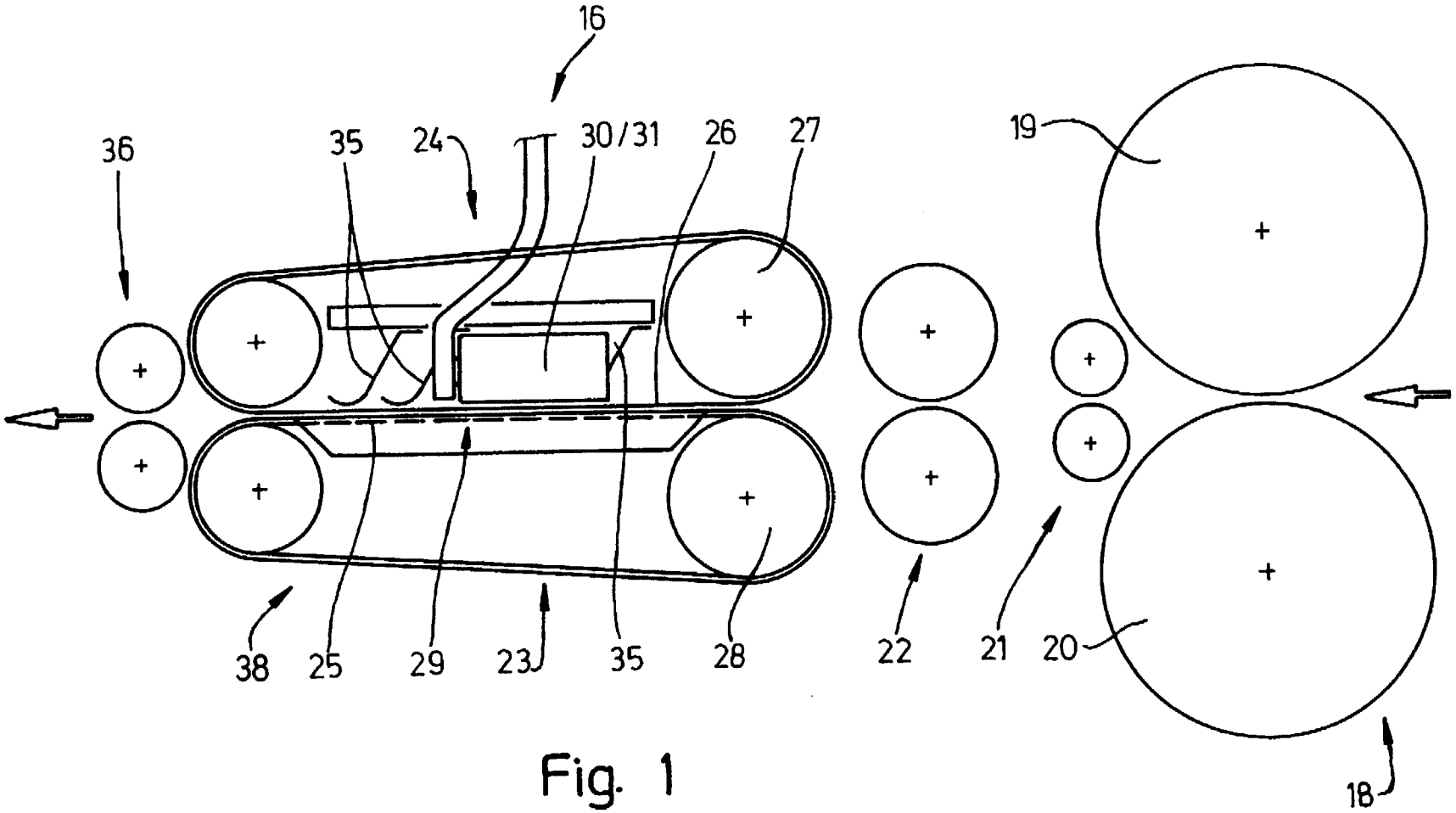
FIG. 1 shows a side view of an apparatus for the production and treatment of blanks for collars.

The described exemplary embodiment of an apparatus is set up for the treatment, specifically the pre-shaping of blanks 10 for the collar in hinge-lid packs. Collars or the blanks 10 therefor conventionally have a special, characteristic shape, which emerges from the ground plan shown in FIG. 2. Such a blank 10 consists of a central collar front wall 11, and collar side tabs 12, 13 extending on both sides thereof. In the position appropriate for the pack in a hinge-lid pack, the collar side tabs 12, 13 are formed at a right angle relative to the collar front wall 11. In this manner, (upright) edges 14, 15 are formed between the mentioned blank parts. The edges 14, 15 shall be correspondingly rounded for a hinge-lid pack with rounded longitudinal edges. A corresponding deformation is carried out in the region of a shaping station 16 of the apparatus.

The blanks 10 are successively severed from a continuous web of material 17 made from thin cardboard. For this purpose, the web of material 17 runs through a cutting unit 18. In the present case, this cutting unit 18 is comprised of two rollers, specifically a cutting roller 19, and a counter roller 20.

Downstream of the cutting unit 18, the severed blanks 10 with their characteristic contours are grasped by conveying rollers 21, which are driven at the same speed as the rollers of the cutting unit 18.

Thereafter, the individual blanks 10 are taken over by accelerating rollers 22. These are driven at a noticeably higher speed than the conveying rollers 21. As a result, the blanks are accelerated. Thereby, a greater distance between the successive blanks is formed.

From the accelerating rollers 22, the blanks 10 are transferred to the shaping station 16. In the region thereof, the blanks 10 are transported by a blank conveyor 38, especially an endless conveyor, namely by centrally arranged belt conveyors. These are a lower belt conveyor 23, and an upper conveyor 24 arranged above, which is preferably designed and dimensioned in the same, or in a similar manner, as the belt conveyor 23. An upper conveying strand 25 of the belt conveyor 23, and a lower pressure strand 26 of the upper conveyor 27, rest against another along the conveying path. Between the conveying strand 25, and the pressure strand 26, the blanks 10 are received, specifically with the collar front wall 11, or a portion thereof.

The aforementioned endless conveyors are driven at the same speed as the accelerating rollers 22. For the correct transfer of the blanks 10 to the conveyor belt 23, deflecting rolls 27, 28 are arranged at a distance from the accelerating rollers 22, which is slightly smaller than the dimensions of the blanks 10, in the conveying direction. The blanks 10 are thus grasped between the deflecting rolls 27, 28 before they are released by the accelerating rollers 22.

The blanks 10 are transported through the shaping station 16 by the blank conveyor 38, which is comprised of the belt conveyor 23, and the upper conveyor 24. The belt conveyor 23 and upper conveyor 24 are driven such that, in the region of the shaping tools, a relatively longer standstill phase for the blanks 10 is ensured for shaping the edges 14, 15.

Figure 3:
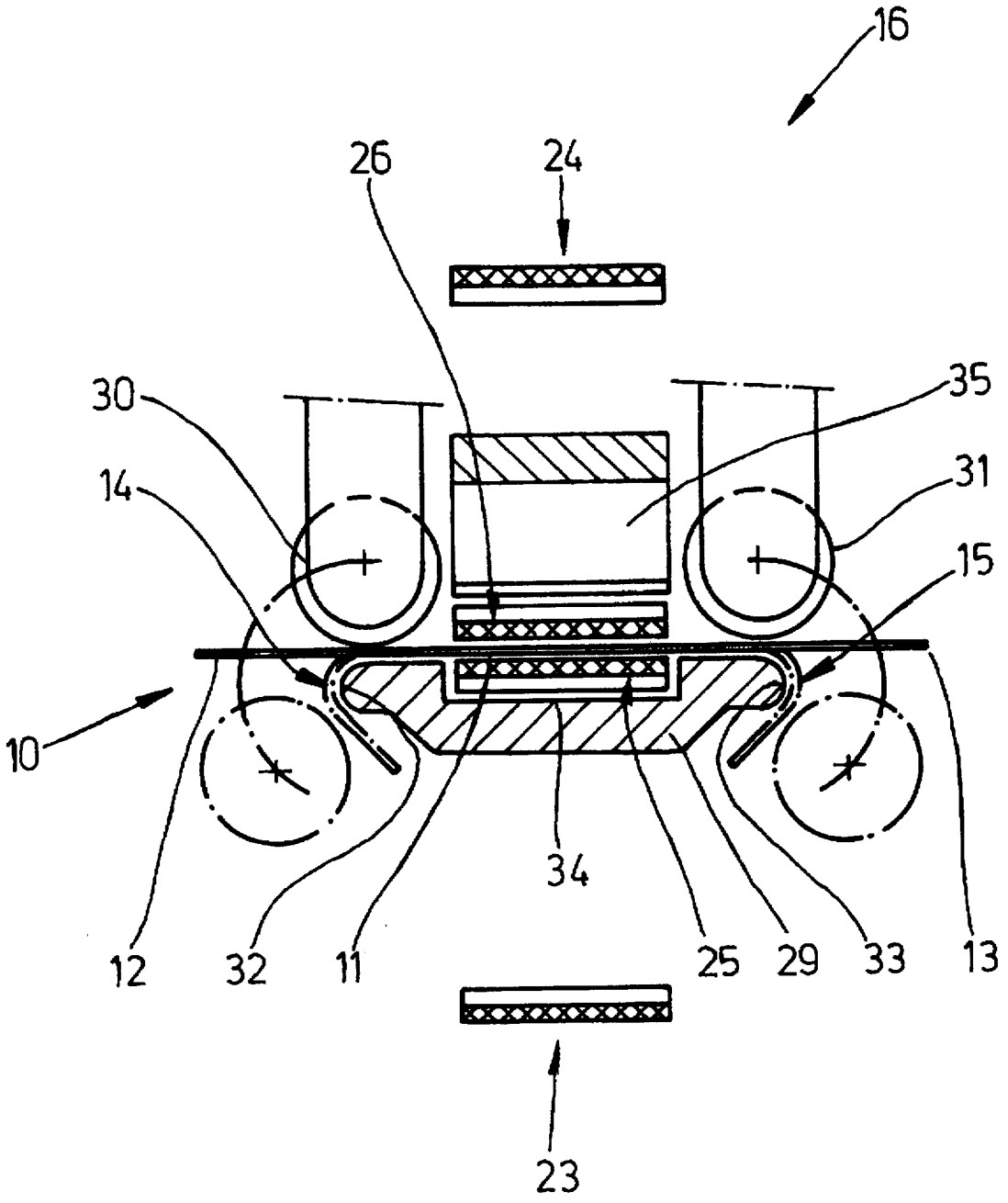
FIG. 3 shows a cross section of the apparatus according to FIGS. 1 and 2, in the region of the shaping station.

The shaping tools are comprised of a stationary shaping plate 29, and movable shaping rollers 30 and 31. These shaping rollers 30, 31 operate in the manner described in DE 41 02 005. For shaping the edges 14, 15 they are moved sideways from an upper position, and then downwards, thereby adjoining the shaping plate 29, or round shaping margins 32, 33. In FIG. 3, the lower final position of the shaping rollers is shown in dot-dash lines.

The shaping plate 29 is provided with a central recess 34 extending in the longitudinal direction. The conveying strand 25 runs in this recess such that it is approximately flush with the shaping plate 29.

During the transport of the blanks 10 between the conveyor strand 25 and the pressure strand 26, especially in the region of the shaping tools, the blanks 10 shall be positioned in a fixed relative position. For this purpose, the belt conveyor 23, and upper conveyor 24, are designed with a surface displaying a large coefficient of friction. Furthermore, the conveying strand 25, and the pressure strand 26, contact one another with increased pressure. In the present exemplary embodiment, a contact pressure is exerted on the pressure strand 26, specifically by pressure members arranged above the pressure strand 26, which take the form of leaf springs 35.

The blanks 10 deformed in the described manner are moved back into the extended position during the further transport, specifically by means of lateral guide members (not shown), on which the collar side tabs 12 slidably rest. The blanks 10 formed back into an approximately flat position are subsequently taken over by stripping rollers 36 downstream of the belt conveyor 23. The stripping rollers 36 transfer the blanks to a transverse conveyor 37 for the further transport of the blanks 10 to the packaging machine, preferably corresponding to DE-41 02 005.

Figure 2:
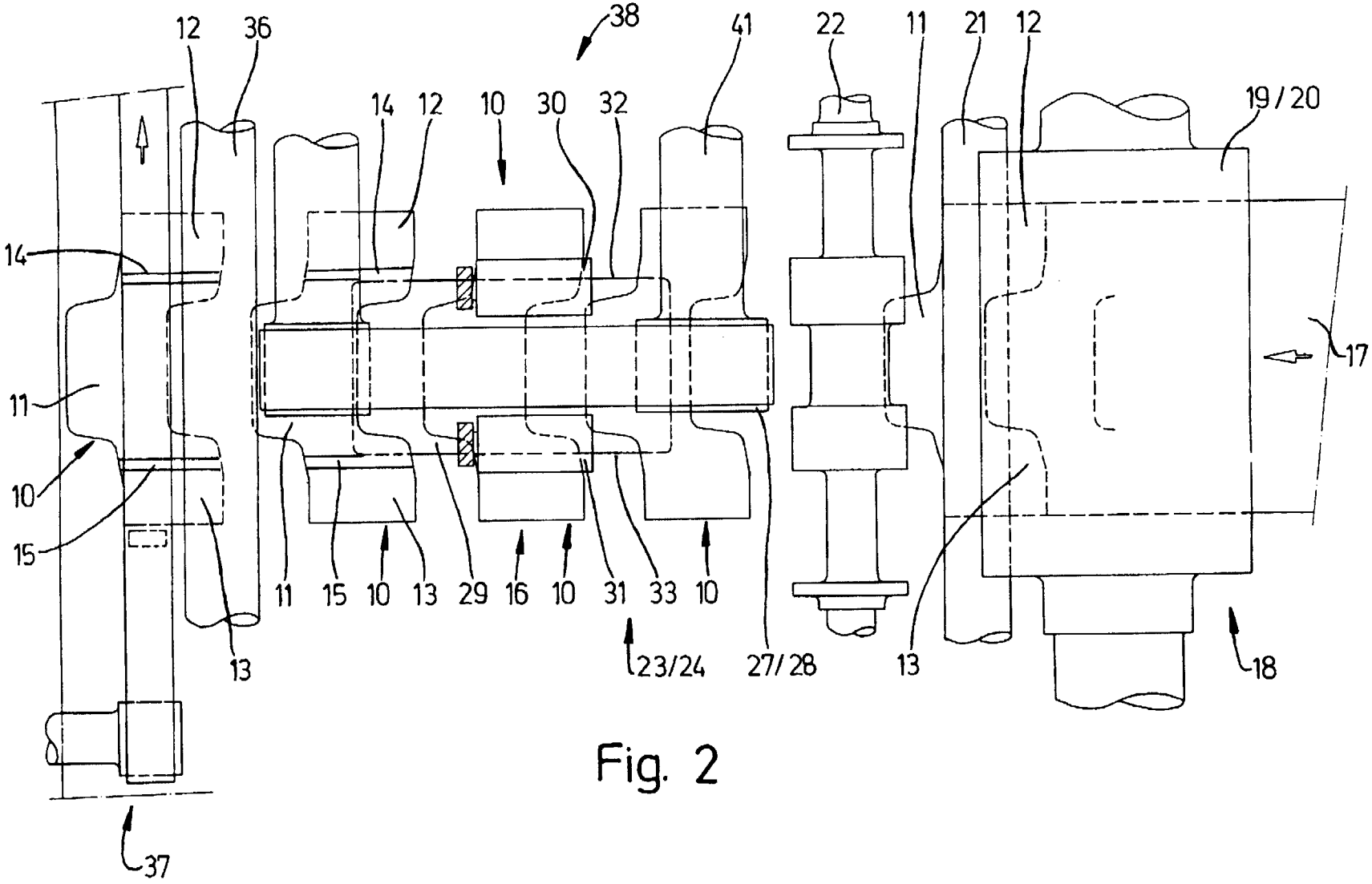
FIG. 2 shows a diagrammatic ground plan of the apparatus according to FIG. 1.

The blank conveyor 38, comprising the belt conveyor 23 and the upper conveyor 24, is driven in cycles. The drive is transmitted to the (larger) deflecting wheels 27, 28. The characteristic motion is designed such that, in the present case, three blanks 10 can be received in the region of the belt conveyor 23. Each blank 10 thus goes through three stop positions in the region of the shaping station 16, or the blank conveyor 38. As a result of the stop phase, the distances between successive blanks are reduced, as shown in FIG. 2.

The apparatus is expediently driven by a basically known step-by-step transmission, which is common in the market.

What is claimed is:

1. An apparatus for production and pre-shaping of blanks (10) for collars of a hinge-lid pack with rounded or polygonal longitudinal edges, wherein the collar blanks (10) are successively severed from a moving web (17) of material and fed to a shaping station in which each blank (10) is shaped during a standstill phase by shaping tools (29, 30, 31) to form rounded or polygonal shaped collar edges (14, 15) between a collar front wall (11) and each of two collar side tabs (12, 13) of each blank said apparatus comprising:

a) in the shaping station (16), an intermittently driven blank conveyor (38) for transporting the blanks (10) in a longitudinal conveying direction through the shaping station (16), b) said blank conveyor (38) comprising an intermittently driven lower belt conveyor (23) having an upper conveying strand (25) on which the blanks rest and are transportable thereon in a spread-out position;

c) a stationary shaping plate (29) in the shaping station (16), each blank (10) being transported in said longitudinal conveying direction by said upper conveying strand (25) of said belt conveyor (23) to a top side of said shaping plate (29), d) wherein the shaping plate (29) has a recess (34) which extends in the longitudinal direction thereof and in which said upper conveying strand (25) of said lower belt conveyor (23) runs, so that said upper conveying strand (25) extends almost flush with the top side of said shaping plate (29);

e) holding means (26, 37) for holding the blanks (10) on top of the shaping plate (29), during the standstill phase of the conveying strand (25), so that the collar side tabs (12, 13) project transversely from opposite sides of said shaping plate (29); and f) two movable shaping tools (30, 31) for forming the rounded or polygonal shaped collar edges (14, 15) of the blank by moving downwardly from an upper starting position above said shaping plate to press the blank (10), during the standstill phase, against correspondingly shaped longitudinally extending shaping edges (32, 33) of said shaping plate (29), said movable shaping tools moving the transversely projecting collar side tabs (12, 13) out of the spread-out position against a bottom side of the shaping plate (29), g) said blank conveyor (38), after the shaping tools (30, 31) have returned to said upper starting position, transporting each shaped blank (10) out of the shaping station (16) to a transverse conveyor (37).

2. The apparatus as claimed in claim 1, further comprising:

a pressure member including a driven upper conveyor (24) having a lower pressure strand (26) located above the lower belt conveyor (23), so that the blanks (10), which rest on the upper conveying strand (25) of the lower belt conveyor (23), are fixed on a free upper side thereof by said lower pressure strand (26) which rests on top of the upper conveying strand (25) and the blanks (10); and means for driving the lower pressure strand (26) of the upper conveyor (24) during the same stroke, at the same speed, and in the same conveying direction as said intermittently driven lower belt conveyor (23).

3. The apparatus as claimed in claim 2, further comprising flexible leaf springs (35) which exert pressure on the lower pressure strand (26) of the upper conveyor (24) so that the lower pressure strand (26) and the upper conveying strand (25) of the belt conveyor (23) are pressed together.

4. The apparatus as claimed in claim 1, wherein said upper conveying strand (25) is dimensioned such that at least three successive ones of the blanks (10), which are arranged at a distance from one another on said lower conveying strand, are simultaneously transported in the conveying direction, and such that a respective blank (10), which is in the center position of the three blanks (10) which rest on the upper conveying strand (25), is located in a shaping region of the shaping tools (29, 30, 31).

5. An apparatus for production and pre-shaping of blanks (10) for collars in conjunction with production of hinge-lid packs with rounded or polygonal longitudinal edges, the blanks (10) being successively severed from a web (17) of material and fed at a speed in a conveying direction by a blank conveyor to a shaping station (16) in which the blanks are shaped, during a standstill phase, by shaping tools (29, 30, 31) to form rounded or polygonal collar edges (14, 15) between a collar front wall (11) and two collar side tabs (12, 13), said apparatus comprising:

a) a cutting device (18) for successively severing the blanks from the web (17) moving at a speed;

b) an accelerating conveyor (22) following, in the conveying direction of the blanks (10), the cutting device (18) for accelerating the severed blanks to a higher speed such that the blanks (10) are spaced apart at a greater distance than following blanks (10);

c) a blank conveyor (38) for receiving the blanks (10) from the accelerating conveyor while maintaining said greater distance, said blank conveyor (38) including a belt conveyor (23), d) the accelerating conveyor (22) and the blank conveyor (28) being separated by a distance slightly less than a dimension of the blank (10) in the conveying direction, e) said belt conveyor following the accelerating conveyor (22) and having an upper conveying strand (25) on which the blanks are transportable in a spread-out position and are feedable up to the shaping station (16) by said belt conveyor; and f) above the belt conveyor (23), an upper conveyor (24) having a lower pressure strand (26) which rests against a top side of the blanks (10) on the conveying strand (25).

6. The apparatus as claimed in claim 1, wherein the movable shaping tools are shaping rollers (30, 31) which have a longitudinal extension that is directed parallel to the conveying direction of the blank conveyor (28), and which for shaping the collar edges (14, 15), are movable downwards from an upper position around the shaping edges (32, 33) and back while resting against the blank (10) or against the shaping edges (32, 33).

* * * * *